US007518055B2

(12) United States Patent
Zartarian

(10) Patent No.: US 7,518,055 B2
(45) Date of Patent: Apr. 14, 2009

(54) SYSTEM AND METHOD FOR INTELLIGENT EQUALIZATION

(76) Inventor: Michael G. Zartarian, c/o Bose Corporation The Mountain, Framingham, MA (US) 01701

( * ) Notice: Subject to any disclaimer, the term of this patent is extended or adjusted under 35 U.S.C. 154(b) by 21 days.

(21) Appl. No.: 11/680,947

(22) Filed: Mar. 1, 2007

(65) Prior Publication Data

US 2008/0212798 A1 Sep. 4, 2008

(51) Int. Cl.
*G10H 1/00* (2006.01)
*G10H 1/18* (2006.01)
*G10H 7/00* (2006.01)

(52) U.S. Cl. ..... 84/615; 626/653; 626/662; 626/737

(58) Field of Classification Search ..... None
See application file for complete search history.

(56) References Cited

U.S. PATENT DOCUMENTS 6,376,761 B1 * 4/2002 LaMarra et al. ..... 84/670
6,728,382 B1 * 4/2004 Silfvast ..... 381/119
6,985,595 B2 * 1/2006 Kohyama et al. ..... 381/119
7,279,631 B2 * 10/2007 Celi et al. ..... 84/735
2004/0094022 A1 * 5/2004 Miwa ..... 84/625
2005/0019021 A1 1/2005 Takahashi
2006/0060071 A1 * 3/2006 Kato et al. ..... 84/645
2007/0234880 A1 * 10/2007 Adams et al. ..... 84/601

FOREIGN PATENT DOCUMENTS

EP 1494502 1/2005
EP 1708395 10/2006
GB 2177575 1/1987

OTHER PUBLICATIONS

International Search Report and Written Opinion dated Aug. 7, 2008 for PCT/US08/052604.

* cited by examiner

*Primary Examiner*—Marlon T Fletcher
(74) *Attorney, Agent, or Firm*—Bose Corporation

(57) ABSTRACT

An equalizer/mixer receives an input signal from a musical source and equalizes the input signal based on the musical source using equalization parameters associated with the musical source. User-adjustable equalization controls may be applied where the equalization parameters defining the controls are associated with the musical source.

16 Claims, 10 Drawing Sheets

SYSTEM AND METHOD FOR INTELLIGENT EQUALIZATION

BACKGROUND OF THE INVENTION

The present invention relates to filtering of electrical/acoustic signals.

SUMMARY OF THE INVENTION

An equalizer/mixer receives an input signal from a musical source and equalizes the input signal based on the musical source using equalization parameters associated with the musical source. User-adjustable equalization controls may be applied where the equalization parameters defining the controls are associated with the musical source.

One embodiment of the present invention is directed to an apparatus comprising: at least one channel receiving an electrical signal representing an acoustic signal generated by an instrument connected to the at least one channel, the instrument selected from a plurality of instruments; at least one control allowing a user to select a setting of an equalization parameter of a first set of equalization parameters; and a processor configured to equalize the electrical signal according to the selected setting, the first set of equalization parameters based on the instrument. In some embodiments, the processor is configured to apply a second set of equalization parameters to the electrical signal, the second set of equalization parameters based on the instrument. In some embodiments, the first set of equalization parameters include a gain range, a center frequency, and a Q, the gain range defining a range of gains selectable by the at least one control. In some embodiments, the at least one control includes a first control, a second control, and a third control. In some embodiments, the first set of equalization parameters define a gain range for each of the first, second, and third controls, the first, second, and third controls operating as a three-band equalizer. In some embodiments, each band of the three-band equalizer is non-contiguous to each of the other bands.

Another embodiment of the present invention is directed to an apparatus comprising: at least one channel adapted to receive an input electrical signal representing an acoustic signal generated by an instrument connected to that at least one channel; and a processor adapted to equalize the input electrical signal according to at least one pre-determined equalization parameter, the at least one pre-determined equalization parameter based on the instrument. In some embodiments, the apparatus further comprises a memory readable by the processor, the memory storing the at least one pre-determined equalization parameter for the instrument. In some embodiments, the apparatus further comprises at least one control allowing a user to adjust a second equalization parameter applied to the input electrical signal, the second equalization parameter based on the instrument. In some embodiments, the at least one control adjusts a gain of a band filter, the band filter characterized by a center frequency, a Q, and a gain range, the center frequency, Q, and gain range based on the instrument.

Another embodiment of the present invention is directed to a method of equalizing an electrical signal representing an acoustic signal generated by an instrument, the method comprising: providing an equalizer/mixer configured to receive the electrical signal and equalize the electrical signal, the equalizer/mixer including a memory and a control adjustable by a user; retrieving a first set of equalization parameters from the memory, the first set of parameters based on the instrument; assigning a portion of the first set of parameters to the control; and equalizing the signal based on the first set of equalization parameters and a control setting of the control. In some embodiments, the method further comprises retrieving a second set of equalization parameters from the memory, the retrieved second set of equalization parameters based on the instrument; and equalizing the signal based on the second set of equalization parameters. In some embodiments, the method further comprises identifying the instrument. In some embodiments, a user manually identifies the instrument to the equalizer/mixer. In some embodiments, the equalizer/mixer automatically identifies the instrument using a handshake protocol between the instrument and the equalizer/mixer.

Another embodiment of the present invention is directed to an apparatus comprising: a plurality of channels, each of the plurality of channels adapted to receive an electrical signal representing an acoustic signal generated by an instrument connected to the channel; at least one user-adjustable control for identifying the instrument connected to the one of the plurality of channels; a memory storing a plurality of equalization parameter sets, at least one of the plurality of equalization parameter sets based on the identified instrument; and a processor configured to retrieve the one of the plurality of equalization parameter sets based on the identified instrument and equalize the electrical signal based on the retrieved parameter set. In some embodiments, the apparatus further comprises a mixer configured to combine an equalized signal from at least one of the plurality of channels, the combined equalized signal played through an amplification system into a venue. In some embodiments, the at least one user-adjustable control selects a setting of an equalization parameter of the retrieved parameter set. In some embodiments, the at least one of the plurality of equalization parameter sets is based on a model of the identified instrument. In some embodiments, the at least one of the plurality of equalization parameter sets is based on a category of the identified instrument. In some embodiments, at least one of the plurality of equalization parameter sets includes a first set of equalization parameters for equalizing the electrical signal representing the acoustic signal generated by the instrument, the first set of equalization parameters based on the instrument. In some embodiments, the at least one of the plurality of equalization parameter sets includes a second set of equalization parameters defining a range of the at least one user-adjustable control, the processor equalizing the electrical signal representing the acoustic signal generated by the instrument based on a setting of the at least one user-adjustable control and the second set of equalization parameters, the second set of equalization parameters based on the instrument. In some embodiments, the electrical signal representing an acoustic signal generated by an instrument is from a live performance.

DETAILED DESCRIPTION

Figure 1:
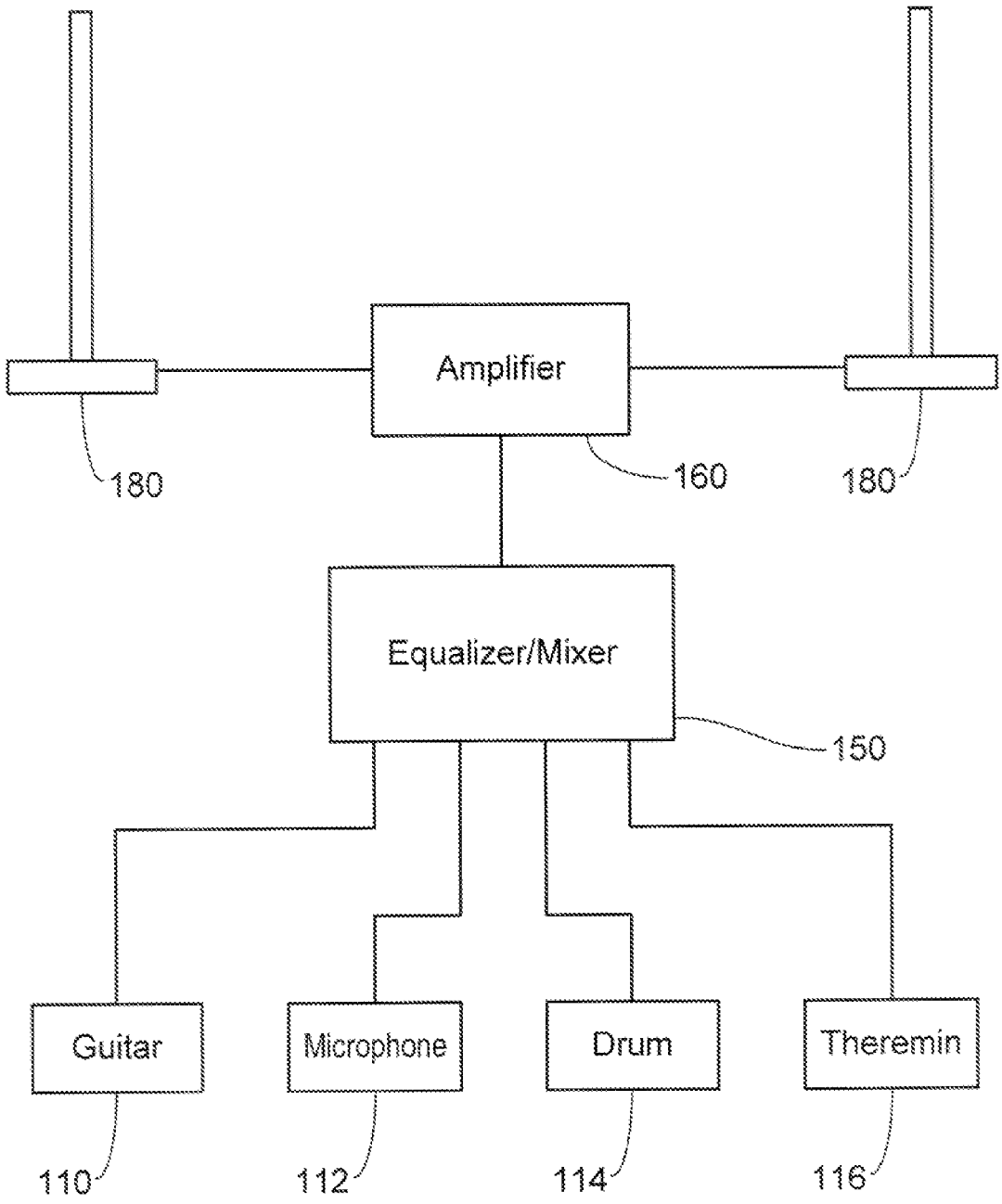
FIG. 1 is a block diagram illustrating an embodiment of the present invention

In a typical live music performance in a large venue, the musical instruments and voices are usually amplified in order to enable everyone in the venue to hear the music. When listening to such a live performance, an audience member's perception of the performance is affected by the acoustics of the musical instrument, the amplification system, the speakers generating the amplified acoustic signal of the instrument, and the acoustics of the venue.

From a musician's perspective, the musician desires to give the audience member a pleasant musical experience regardless of the particular venue or amplification system. To that end, musicians may provide their own amplification system, frequently called a PA system, including, for example, microphones, mixers, amplifiers, and loudspeakers. By providing their own PA system, the musician controls the effect of the PA system on the musical experience.

The musician can control, or at least reduce the effect of, the venue on the musical experience by filtering a signal representing his/her performance prior to being broadcast over the loudspeakers. The process of filtering a signal to compensate for the acoustic properties of the instrument, PA system, or venue is usually referred to as equalization.

Typically, the musician's PA system includes an equalizer that allows the musician to adjust the signal representing his/her performance. For example, one venue may exhibit a resonance at a first frequency range while a second venue may exhibit a resonance at a second frequency range. When the musician plays in the first venue, he may wish to filter the performance signal to compensate for the resonance in the first frequency range. When the musician plays in the second venue, he may adjust the filter to compensate for the resonance in the second frequency range.

A common type of equalizer is a one-third octave graphic equalizer that partitions the frequency range perceptible by humans into 31 one-third octave frequency bands that may be independently adjusted by the user. Such an equalizer allows for very precise equalization but at increased cost and complexity. Equalizers may be simplified by partitioning the audible frequency range into a smaller number of bands but with less precise control. In simplified equalizers, each frequency band is wider because there are fewer bands that span the audio frequency spectrum. Furthermore, the center frequencies of each band are usually fixed and cannot be altered by the user.

The user may have even less control adjusting the equalization in these fixed band equalizers due to the characteristics of the musical source attached to the equalizer. For example, a three band equalizer may have fixed bands covering the low, mid, and high bands of the audio spectrum. If the user connects a flute to the equalizer, the user may find that only the high band control makes a perceptible change in the acoustic signal because most of the energy generated by the flute is in the high band. The fixed low and mid bands contain little energy from the flute and adjustments in these frequency bands produce litter perceptible effect. Conversely, if the user connects a bass guitar to the equalizer, the user may find that only the low band control produces a perceptible effect.

FIG. 1 is a block diagram illustrating an embodiment of the present invention. In FIG. 1, one or more musical sources 110, 112, 114, and 116 are connected to an equalizer/mixer 150. The equalized/mixed signal is transmitted from the equalizer/mixer 150 to an amplifier 160 where the signal is amplified. The amplified signal drives one or more loudspeakers 180 that convert the amplified signal to an amplified acoustic signal. The equalizer/mixer may transmit the equalized/mixed signal to a second amplifier (not shown) that may be used to drive a low frequency loudspeaker (not shown).

The equalizer/mixer 150 can accept input signals from a variety of musical sources. In the example shown in FIG. 1, a guitar, microphone, drum, and theremin are connected to the equalizer/mixer 150 and are representative of the variety of musical sources that may be connected to the equalizer/mixer but is not limited to those instruments. Although the equalizer/mixer 150 illustrated in FIG. 1 shows four inputs, it is understood that the equalizer/mixer 150 is not limited to only four inputs but may be configured to accept more than four or less than four inputs. The musical sources connected to the equalizer/mixer 150 do not have to be different. For example, in FIG. 1 the musical sources may be all microphones or three guitars and one microphone or just a guitar and a microphone or any other combination of musical sources. The musical source may also include pre-recorded music or other pre-recorded sounds.

Loudspeaker 180 is preferably a linear speaker array such as those described in U.S. Pending application Ser. Nos. 10/610,466 filed Jun. 30, 2003 and 11/246,468 filed Oct. 6, 2005, herein incorporated by reference in their entirety. Other types of loudspeakers may also be used to generate the amplified acoustic signal.

Amplifier 160 may be housed in a separate housing or may be housed in a base support for the loudspeaker 180. A separate amplifier may be used to drive each loudspeaker or amplifier 160 may drive more than one loudspeaker.

Figure 2:
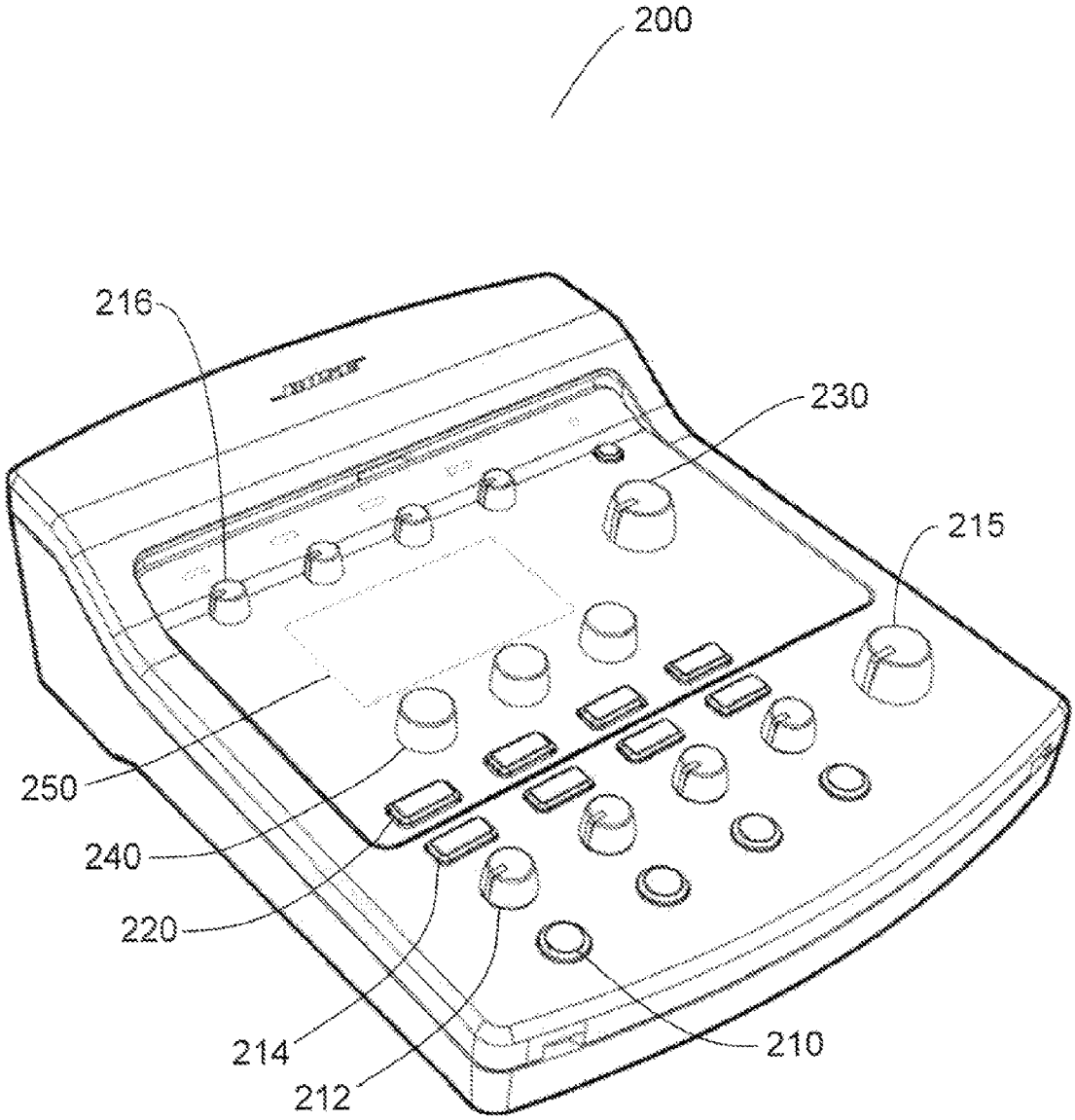
FIG. 2 is a perspective view of a user interface in an embodiment of the present invention.

FIG. 2 is a diagram illustrating a user interface for the equalizer/mixer 150. The user interface for the equalizer/mixer 200 includes separate channel controls for each musical source. Channel controls include a volume control 212, volume Mute control 210, and an Effects Mute control 214. A master volume control 215 adjusts the volume of all the channels. Each channel may also include a trim control 216 enabling the user to adjust an analog pre-amplifier gain for each channel. The equalizer/mixer 150 includes ports (not shown) along the rear panel where musical sources may be connected. Each channel may be configured to accept a monophonic signal or a stereo signal from the musical source. The musical source may be a single instrument such as a guitar or drum or may be a mixed/equalized signal of several instruments from another equalizer/mixer. In this way, more than one equalizer/mixer may be daisy chained to mix and equalize any number and combination of musical sources.

Equalization or special effects for each channel may be adjusted by the user through the operation of one or more controls on the user interface 200. Equalization control include a function selector switch 230, a channel edit button 220 for each channel, and one or more soft controls 240. A display 250 provides information to the user. The user can independently adjust each channel by depressing the desired channel edit button 220 and turning the function selector switch 230 to the desired function.

The function selector switch 230 selects a variety of functions that the user or performer can use or adjust. A representative but not exhaustive list of functions selectable by the function selector switch 230 include: tuner; preset; zEQ; parametric eq; compression/noise gate; modulation; delay;

reverb; reverb type; preferences; scenes; and auxiliary. The tuner function enables the performer to tune his/her instrument by indicating if a predetermined note is flat or sharp. The preset function enables the performer to set equalization parameters based on the instrument connected to the channel. The zEQ function allows the performer to adjust the equalization according to his/her preferences using, for example, a three band equalizer. If the performer has used the preset function to set the equalization parameters, the control parameters for each soft control are also based on the instrument connected to the channel. The parametric equalizer function allows the user to select the center frequency, Q, and gain of a filter. The compression/noise gate function enables the user to adjust the parameters for a compression filter or a noise gate. The modulation, delay, reverb, and reverb type functions are special effects functions that the user can adjust to modify the performance signal. The preference function allows the user to set default values controlling the display of, for example, the I/O meters and provides status information regarding the equalizer/mixer. The scenes function saves the current state of the equalizer/mixer into non-volatile memory and enables the user to save his/her settings. The auxiliary function allows the user to direct a signal from a selected channel to an auxiliary output port.

The user may apply previously stored instrument parameters to the selected channel using the scenes function. The user may have previously adjusted the channel parameters to the user's instrument and may wish to quickly retrieve those instrument parameters at a later time. The use can save the instrument parameters loaded for that channel and recall the instrument parameters at a later time. As used herein, instrument parameters are a set of equalization parameters associated with a specific instrument and may be stored in a memory area of the equalizer/mixer. When the user plugs his/her instrument into one of the channels of the equalizer/mixer, the user can select from a library of instrument parameters a set of instrument parameters to load into the channel connected to the instrument. The loaded instrument parameters for the channel connected to the instrument are referred to as the channel parameters. As an illustrative example, a user may connect a guitar to a first channel of the equalizer/mixer and select a set of instrument parameters associated with the guitar for the first channel. The first channel is loaded with the guitar instrument parameters and they become the channel parameters for the first channel. At another performance, the user may connect the guitar to a second channel of the equalizer/mixer and a drum to the first channel of the equalizer/mixer and load the instrument parameters accordingly. In this second performance, the channel parameters for the first channel are the instrument parameters for the drum and the channel parameters for the second channel are the instrument parameters for the guitar.

The user may apply pre-determined equalization parameters for a specific instrument by selecting a corresponding instrument parameter set. As used herein, an instrument refers to a specific make and model of an instrument category. Instrument categories refer to types of musical instruments such as, for example, acoustic guitar, trumpet, clarinet, drum, and voice microphone. Each instrument within a category may have different acoustic characteristics arising from different designs and compositions that may require different equalization to bring out the full character of that particular make and mode of instrument. For example, a Martin D-28 Marquis guitar and a Gibson Acoustic J-45 guitar both belong to the acoustic guitar category but may have different acoustic characteristics that make customized equalization parameters for each instrument desirable. A set of equalization parameters may be selected for the Martin D-28 acoustic guitar and a second set of equalization parameters may be selected for the Gibson Acoustic J-45 guitar and saved in their respective instrument file store din a non-volatile memory in the equalizer/mixer. The pre-determined equalization parameters for a specific instrument are hereinafter referred to as the instrument parameters. When the user selects the instrument file associated with the instrument connected to a channel of the equalizer/mixer, the parameters in the selected instrument file are loaded as the equalization parameters for that channel. The pre-determined instrument parameters are set for each instrument according to the particular acoustics of that instrument.

An instrument parameter set may be provided for a "generic" instrument make or category that the user may select if the library of instrument parameters in the equalizer/mixer does not have the instrument parameters for the user's specific instrument. For example, an instrument parameter set labeled "Acoustic Guitar" may be selected as a default setting for acoustic guitars that do not have an instrument parameter set for the specific guitar. Similarly, an instrument parameter set labeled "Gibson Acoustic Guitar" may be used for Gibson acoustic guitars that do not have an instrument parameter set for the specific model of Gibson acoustic guitars. The user may select the default "Acoustic Guitar," the "Gibson Acoustic Guitar," or one of the instrument parameter sets associated with other guitars. Additional instrument parameter sets may be provided for individual instrument manufacturers. For example, a set of instrument parameters for Gibson electric guitars of Fender electric guitars may be provided.

Figure 3:
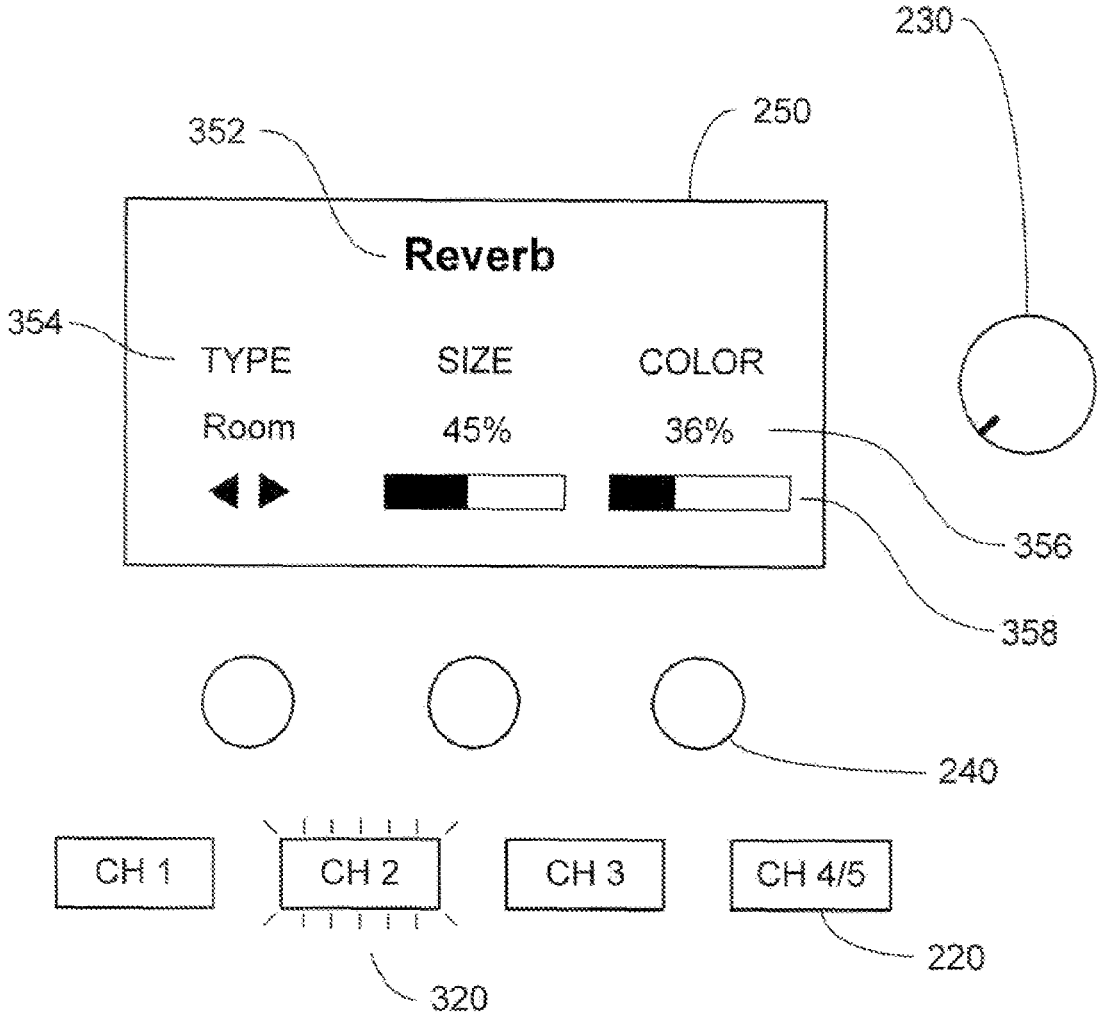
FIG. 3 is a diagram illustrating a portion of the user interface for the embodiment shown in FIG. 2.

FIG. 3 illustrates a portion of the equalizer user interface shown in FIG. 2. In FIG. 3, the user has selected the Reverb special effect by turning the function selector switch 230 to a position for the Reverb special effect. The selected Reverb function is applied to channel 2 by depressing the channel edit button for channel 2. When selected, the selected channel edit button 320 may be lighted to indicate to the user the channel being edited. The selected function is displayed 352 to show the user the selected function. Below the displayed function, three columns provide the user information regarding the function and setting of each of the soft controls 240. In the example shown in FIG. 3, three soft controls 240 are shown but the equalizer/mixer is not limited to only three soft controls. More than three soft controls may be provided to allow for additional control or less than three soft controls may be provided to simplify adjustments. For each soft control, a control name 354 and control setting 356 are displayed. Display 250 may show the control setting graphically using, for example, a bar 358 to indicate the relative position of the current setting within of the control range available to the user. The user may adjust the control setting by rotating the associated soft control 240.

Figure 4A:
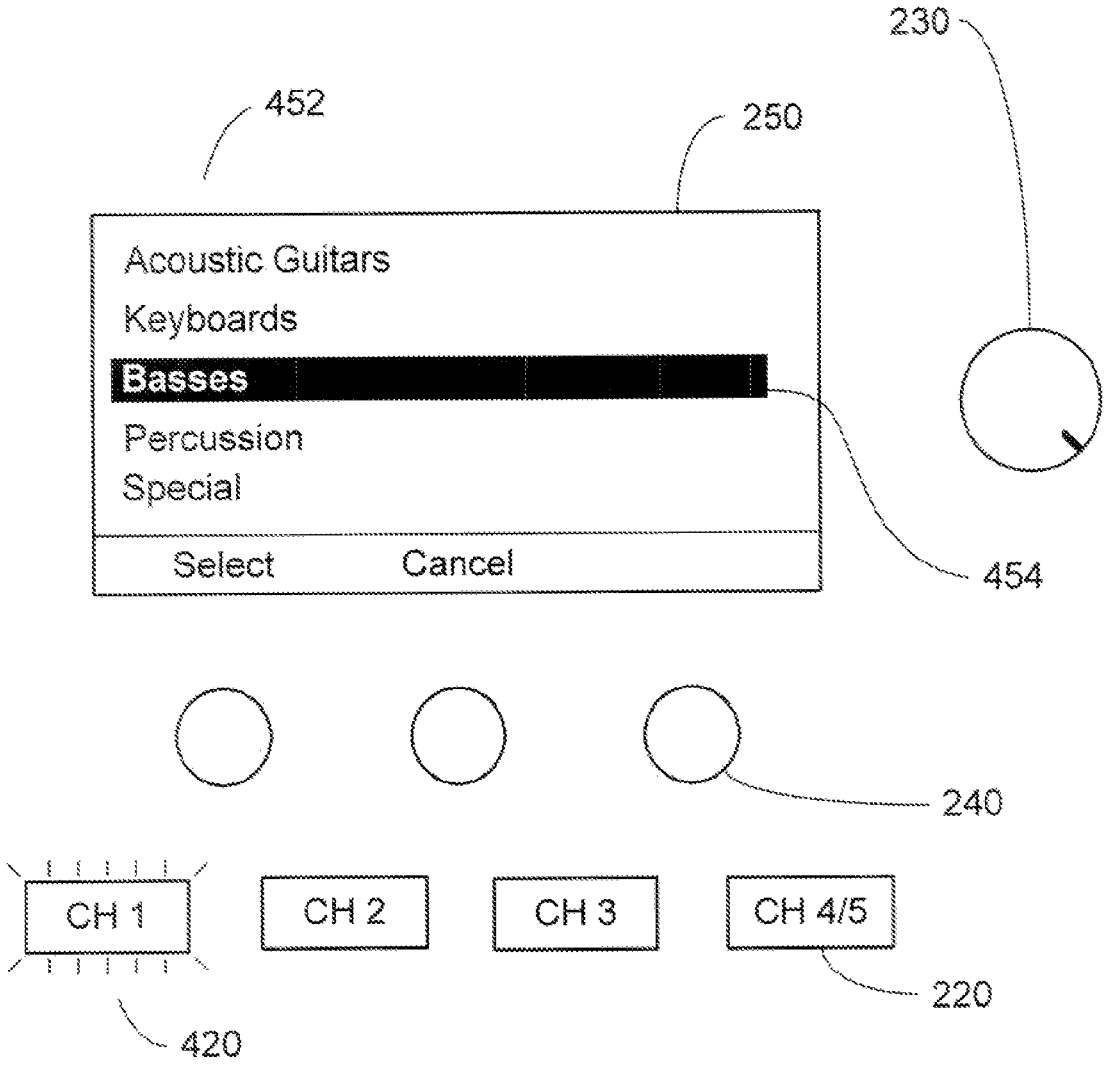
FIG. 4*a* is a diagram illustrating a portion of the user interface for the embodiment shown in FIG. 2.
Figure 4B:
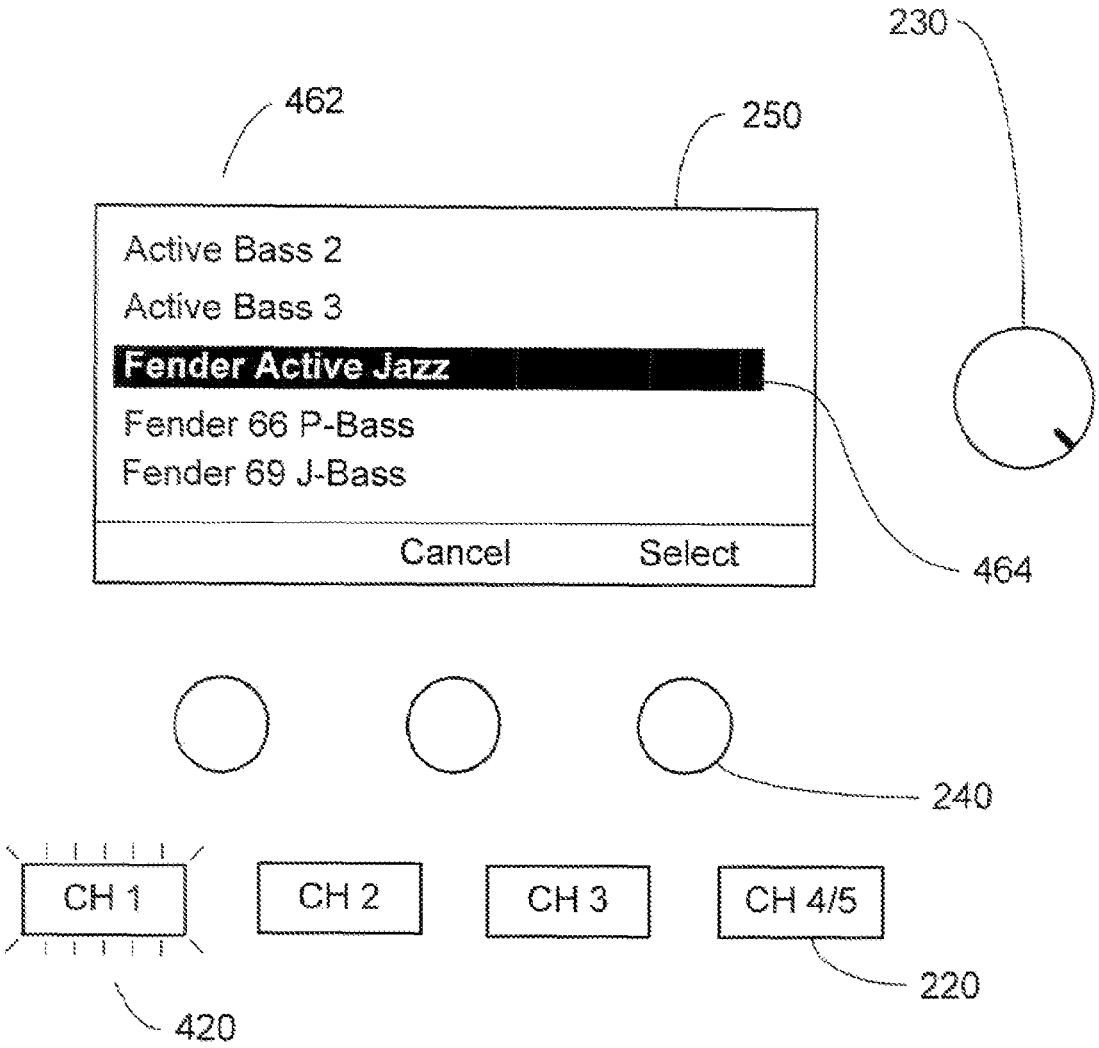
FIG. 4*b* is a diagram illustrating a portion of the user interface shown in FIG. 4*a* after a user action.

FIGS. 4*a-e* illustrate a portion of the equalizer user interface during a selection of equalization parameters for an instrument. In FIG. 4*a*, the user rotates function selector switch 230 to a position corresponding to a Preset function. In FIG. 4*a*, the user has also selected channel 1 by depressing the channel edit button for channel 1, indicated by the lighted channel edit button 420. The user is presented with one or more hierarchal menus that allow the user to select from a list of items using one of the soft controls 240. In FIG. 4*a*, display 250 includes a list of instrument categories 452 such as, for example, acoustic guitars, keyboards, basses, percussion, and special instruments. Special instruments may include non-traditional instrument such as, for example, a washtub bass, a plastic bucket, a chapman stick, a theremin, and other instruments capable of generating a sound. The user may select the instrument category by turning the soft control labeled "Select" in FIG. 4*b* until the desired category is highlighted 454. In FIG. 4*b*, the category "Basses" is highlighted and the user presses the "Select" soft control to select the "Basses" category.

In FIG. 4*b*, a list of bass instruments 462 is displayed when the user selects the "Basses" category in FIG. 4*a*. The list of instruments 462 includes all the instruments in the selected category that have equalization presets available to the user. The user can highlight the instrument on the instrument list 462 that matches the instrument connected to the channel being edited by turning the soft control labeled "Select" until the desired instrument on the instrument list is highlighted. If the specific brand/model of the connected instrument is not listed, the user may select a brand, if listed, or a generic or default instrument. The user selects the highlighted instrument by pressing the "Select" soft control.

Figure 4C:
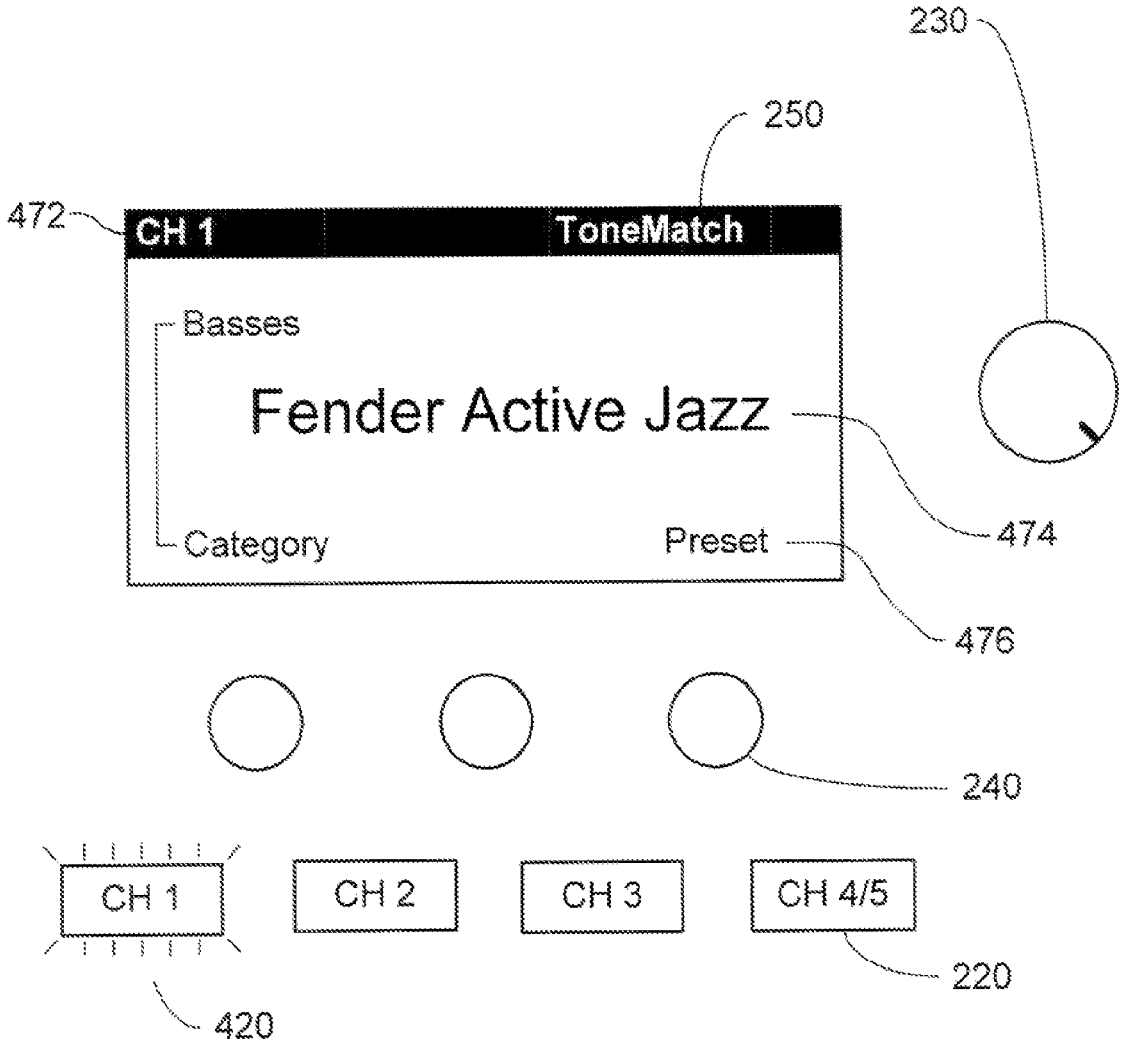
FIG. 4*c* is a diagram illustrating a portion of the user interface shown in FIG. 4*b* after another user action.

When the user presses the "Select" soft control, the highlighted instrument is displayed 474 in the display 250, as shown in FIG. 4*c*. The user can load a predetermined set of instrument parameters customized for that instrument by pressing the "Preset" soft control shown in FIG. 4*c*. In the example shown in FIG. 4*c*, the equalization parameters for a Fender Active Jazz bass is loaded as the channel 1 equalization parameters when the user presses the "Select" soft control.

The user may repeat the procedure shown in FIGS. 4*a-c* for the other channels by depressing a different channel edit button 220 and repeating the steps shown in FIGS. 4*a-c*.

The instrument parameters include two sets of parameters. A first set of instrument parameters equalizes the instrument's signal across the entire audio spectrum or portions thereof for that instrument. For example, a specific brand/model acoustic guitar may have a resonance at a first frequency band. The first set of instrument parameters for that brand/model acoustic guitar may equalize the guitar's resonance in the first frequency band. If the user had selected a different brand/model acoustic guitar or a different instrument such as, for example, a specific brand/model of a flute, the first set of instrument parameters for that selected instrument are used to equalize that specific instrument.

A second set of instrument parameters define the equalization parameters for each of the soft controls in the equalizer/mixer that allow the user to fine control the equalization for the instrument. Examples of equalization parameters that may be included in the second set of instrument parameters include filter type, filter order, corner or center frequency, Q, gain, or the locations of any poles and zeros on the complex plane of the filter's transfer function. In some embodiments, the second set of instrument parameters define a center frequency, Q, and a gain range for each soft control as an N-band equalizer where N is the number of soft controls on the equalizer/mixer. The defined bands are not necessarily contiguous to each other and may be separated by a portion of the audio spectrum. The center frequency and Q for each band may be selected to match the acoustic characteristics of the specific instrument to allow the user more effective equalization control. For example, the center frequency and Q for an instrument may be set to match a portion of the audio frequency spectrum where the instrument generates most, or a large part, of its acoustic energy. As an illustrative example, for a three band equalizer having a low, mid, and high band, the low band parameters may be set such that the center frequency of the low band is 95 Hz, the Q is set to 0.38, and the gain range set to ±15 dB if the musical source is an acoustic guitar. If the musical source is a digital piano, however, the center frequency of the low band may be set to 120 Hz, the Q set to 0.5, and the gain range set to ±12 db. By selecting one or more frequency bands where, for example, the instrument generates large amounts of its acoustic energy, the user can have greater control of the overall quality of the acoustic signal transmitted to a listening volume of the venue.

The original selection of the instrument parameters is preferably done by highly skilled individuals knowledgeable in acoustic engineering that have the ability to perceive small differences in an acoustic signal. These experts may be engaged by musical instrument manufactures to set the instrument parameters for each instrument. The expert and the instrument maker will typically work together to select one or more sets of equalization parameters that enhance the sound quality of the instrument intended by the instrument maker. For some types of musical instruments such as, for example, acoustic instruments, the expert may select instrument parameters to reduce artifacts introduced during the amplification process such that the amplified sound more closely resembles that of the acoustic instrument. The expert may provide more than one set of instrument parameters for an instrument such that each set of instrument parameters highlights a different aspect of the instrument.

Once the instrument parameters are selected by the expert, the instrument manufacturers can provide the instrument parameters with the instrument that would allow performers, who may not have the expertise to select an appropriate set of instrument parameters, to load into the mixer/equalizer and use the provided instrument parameters. By using the predetermined instrument parameters, the user is assured that the equalization provided by the predetermined instrument parameters is what the instrument maker intended for that instrument. In a preferred embodiment, a library of instrument parameters are stored in the equalizer/mixer that can be applied to the equalizer/mixer when the user selects the instrument parameters corresponding to the instrument connected to the equalizer/mixer. The library of instrument parameters may be updated as new instrument parameters are added or refined.

Figure 4D:
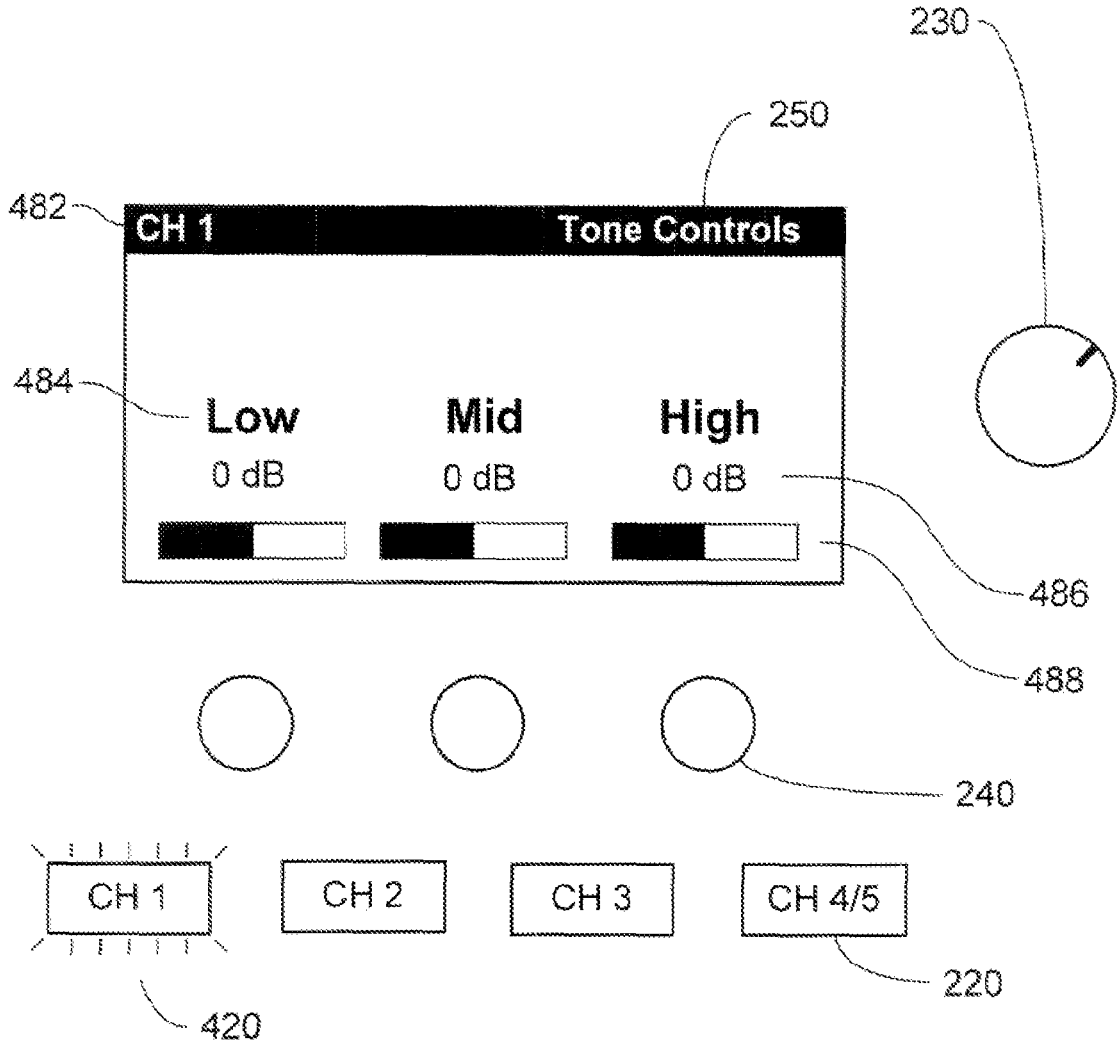
FIG. 4*d* is a diagram illustrating a portion of the user interface shown in FIG. 4*c* after another user action.
Figure 4E:
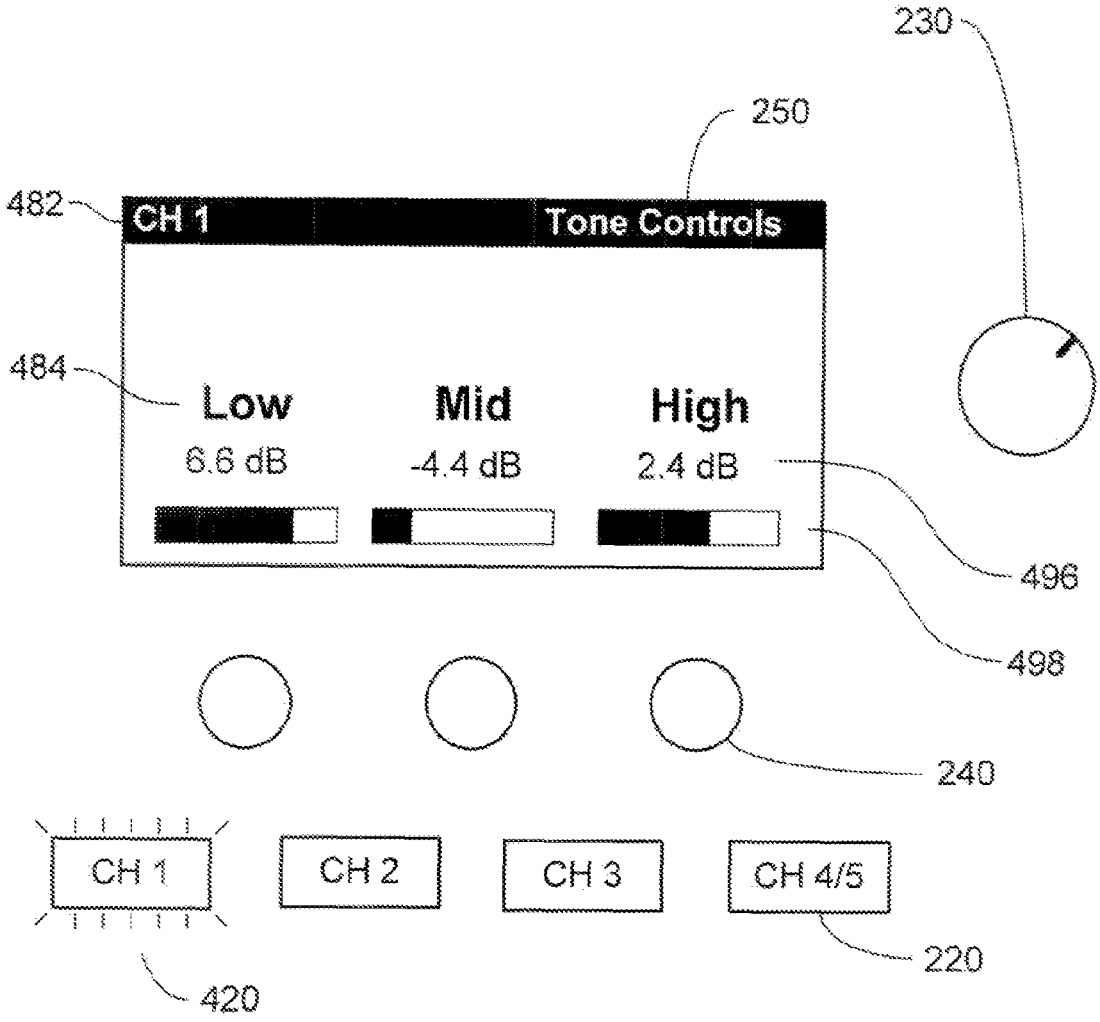
FIG. 4*e* is a diagram illustrating a portion of the user interface shown in FIG. 4*d* after another user action.

After the user has matched the instrument connected to the equalizer/mixer to its corresponding instrument parameters, the user can adjust the equalization of the instrument by rotating the function selector switch 230 to a position corresponding to an equalization function as shown in FIG. 4*d*. In FIG. 4*d*, a portion 482 of display 250 identifies the channel and function selected. In the example of FIG. 4*d*, the tone control function is selected for channel 1. A soft control 240 adjusts a gain for a band filter in a low, middle, or high frequency range. A settings filed 486 displays the gain for each band and a bar 488 graphically display the gain setting relative to the gain range for each band. Initially the gain is set to 0 dB for each band. The user may adjust each band according to his/her preferences, which may in part depend on the venue and type of music performed by the user. In FIG. 4*e*, the user has adjusted the gain for each band and the adjustments are shown in settings field 496 and graphically as a bar 498.

In some embodiments, the frequency band labels of "Low", "Mid", and "High" may be replaced by more descriptive labels corresponding to each instrument. For example, if the selected instrument is a drum, the low frequency band may be labeled "Boom", the mid frequency band labeled "Thud", and the high frequency band labeled "Snap."

In the examples described above, band filters are used to equalize the musical sources but other types of filters may be used according to the musical source. For example, a spectral tilt type control may be used for pre-recorded musical sources. Other type of filters may be used according to the particular characteristics of the musical source.

The Preset function allows the user to manually match the instrument connected to the equalizer/mixer to its appropriate instrument parameter set. Automatic instrument matching may be done based on electrical properties of the instrument connected to the equalizer/mixer. For example, the input impedance of the connected instrument may be used to distinguish instruments such as a digital piano, which has a low impedance, from an electric guitar or microphone, which tends to have a high impedance. Digital instruments may follow a handshake protocol with the equalizer/mixer to automatically identify itself to the equalizer/mixer and enable the equalizer/mixer to retrieve the instrument parameters from its library and load the instrument parameters into the equalizer/mixer. The digital instrument may be configured to store its own instrument set such that if the equalizer/mixer does not have instrument parameters for that digital instrument, it can retrieve the instrument parameters from the digital instrument and save the instrument parameters in it library. Alternatively, if the equalizer/mixer already has instrument parameters for the digital instrument, it may automatically use the most recent instrument parameters.

Instrument parameters may be generated by the equalizer/mixer based on the instrument's range and spectral signature. In some embodiments, the equalizer/mixer may prompt the user to play at least the highest and the lowers note in the instrument's range. The equalizer/mixer evaluates the frequency content of the instrument and generates a preset equalization curve and assigns zEQ tone controls. For example, based on the frequency content of the instrument, the preset equalization curve may decrease the gain in portions of the frequency range where the instrument generates a lot of energy and increase the gain in portions of the frequency range where the instrument does not generate a lot of energy. The zEQ tone controls may be selected to operate in the frequency range having high energy content.

Figure 5:
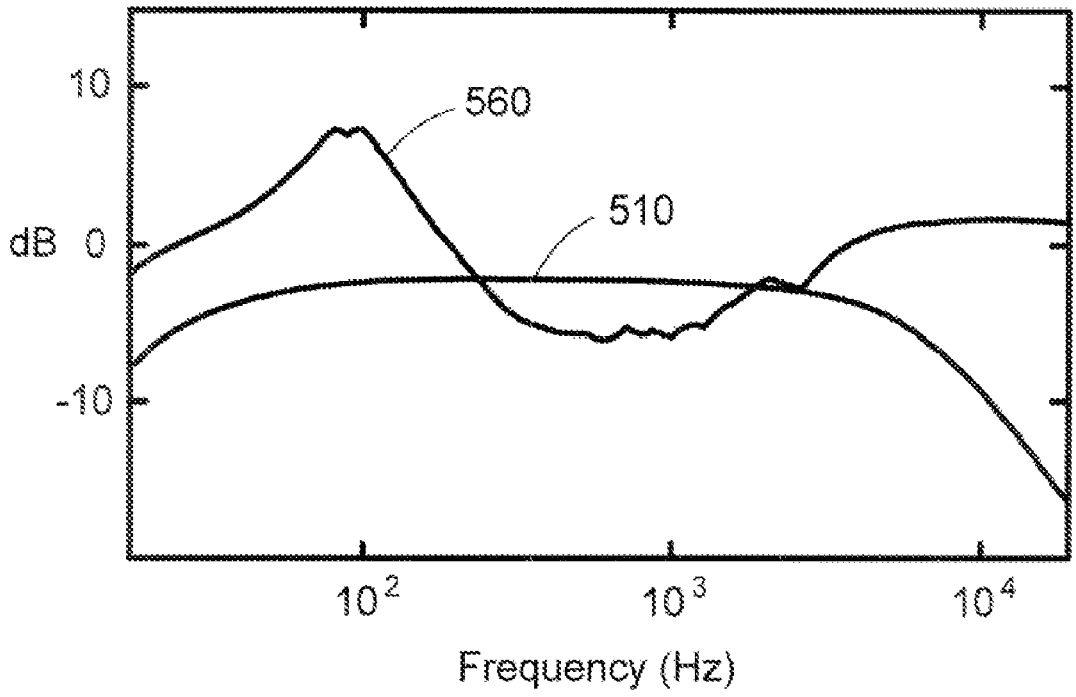
FIG. 5 is graph illustrating exemplar tone curves for two instruments used in an embodiment of the present invention.

FIG. 5 is a graph illustrating exemplar tone curves for two instruments. In FIG. 5, a Fender Active Jazz Bass guitar tone curve 510 and a Taylor acoustic guitar tone curve 560 illustrate different equalization based on the specific instrument. The parameters defining each of the tone curves shown in FIG. 5 are associated with the first set of instrument parameters for their respective instrument. Exemplar tone control parameters for the Fender Active Jazz Bass guitar are shown in Table 1 below.

TABLE 1

| Filter Type | Bass Parametric | Mid Parametric | Treble High Shelf |
|---|---|---|---|
| Center Freq. | 100 Hz | 630 Hz | 1250 Hz |
| Q | 0.35 | 0.40 | 0.50 |
| Gain Range | ±15 dB | ±15 dB | ±15 dB |

Exemplar tone control parameters for the Taylor acoustic guitar are shown in Table 2 below.

TABLE 2

| Filter Type | Bass Parametric | Mid Parametric | Treble High Shelf |
|---|---|---|---|
| Center Freq. | 100 Hz | 2000 Hz | 4000 Hz |
| Q | 0.35 | 0.40 | 0.50 |
| Gain Range | ±15 dB | ±15 dB | ±15 dB |

Figure 6:
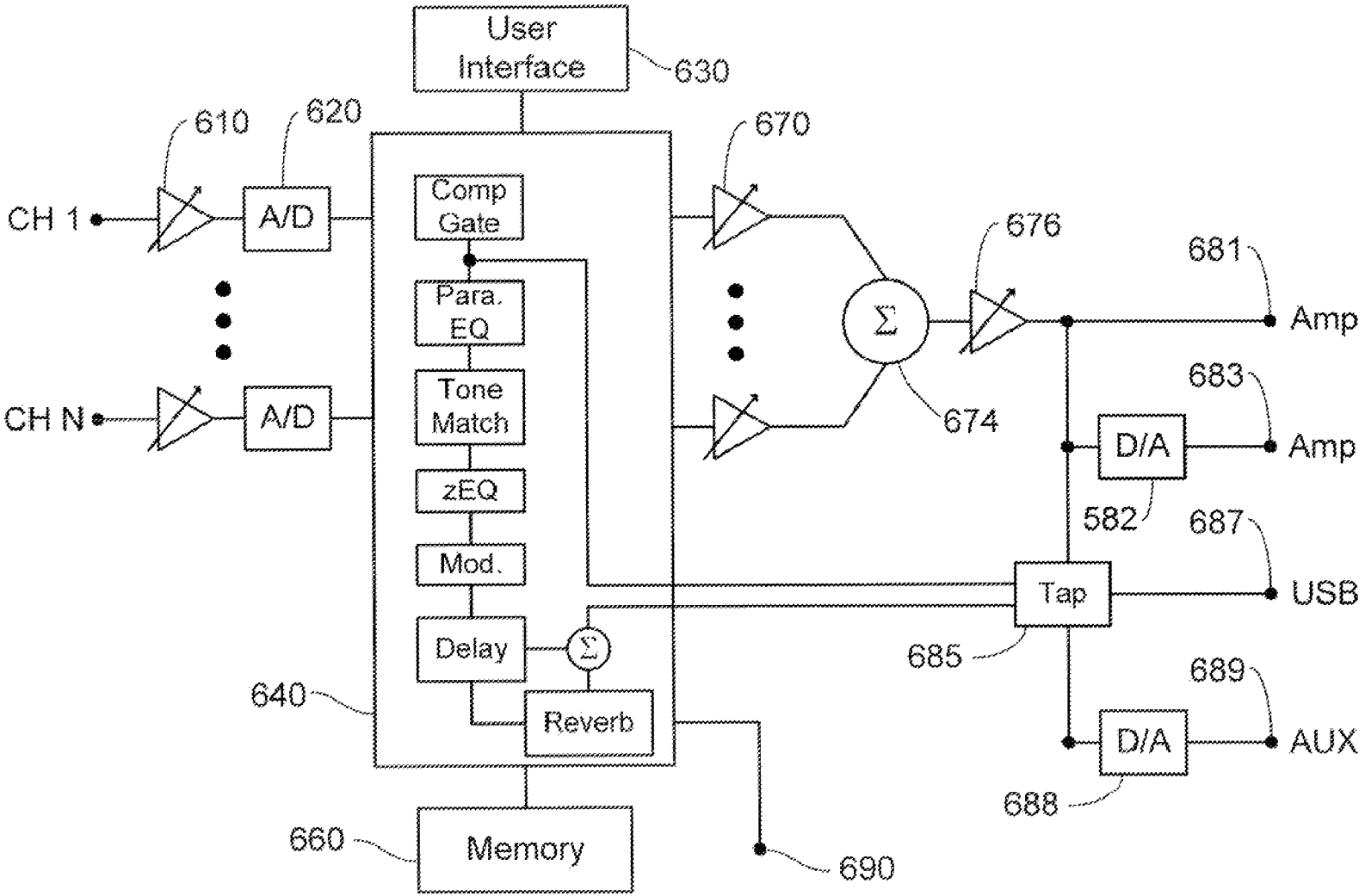
FIG. 6 is a block diagram illustrating an embodiment of the present invention.

FIG. 6 is a block diagram of the equalizer/mixer in an embodiment of the present invention. In FIG. 6, musical sources are connected to one of the N channels in the equalizer/mixer where N is the number of channels in the mixer and can take any value greater than or equal to one. An optional preamplifier 610 may be used to amplify the signal generated by the connected musical source. The user may adjust the gain of preamplifier 610 adjusting the trim control on the user interface 630. Each channel includes an A/D module 620 to convert the analog signal to a digital signal. A digital signal processor (DSP) 640 receives the digital signal from each of the channels and filters each channel signal. DSP filters include special effects functions such as, for example, modulation, delay, and reverb. DSP filters include equalization functions such as, for example, parametric equalization, tone matching, and zEQ. The tone matching function refers to an equalization function based on the characteristics of the instrument selected by the user when the user selects the Preset function on the function selector switch. The zEQ function shown in FIG. 6 refers to the tone control function previously described. The order of the three equalization functions shown in FIG. 6 is not necessary and the equalization functions may be executed in any other order.

The user may set a set of parameters for each DSP filter through the user interface 630. Predetermined parameters or previously saved parameters may be recalled from a non-volatile area of memory 660. Memory 660 is accessible to the DSP and may contain both volatile and non-volatile memory areas. Non-volatile memory may also store computer-executable instructions to perform the DSP filtering indicated in FIG. 6.

After filtering, the volume of each channel may be individually adjusted by the user with the channel volume control on the user interface. Each channel is summed 674 and adjusted with a master volume control on the user interface. The summed signal may be transmitted to an amplifier as a digital signal 681, or as an analog signal 683 after being converted by a D/A converter 682.

A tap 685 may be used to provide a signal from selected points within the filtering process to devices external to the equalizer/mixer. For example, a digital signal may be provided through a USB port 687. Similarly, an analog signal may be provided through an auxiliary port 689 after conversion by D/A converter 688.

A USB port or other type of port may be provided to allow data exchange between the equalizer/mixer and an external device such as, for example, a computer. Data exchange allows the equalizer/mixer to be updated, for example, with firmware updates, new or updated instrument parameters, previously saved parameter sets. Data exchange allows the user to backup previously saved parameters sets.

Embodiments of the present invention comprise computer components and computer-implemented steps that will be apparent to those skilled in the art. For example, it should be understood by one of skill in the art that the computer-implemented steps may be stored as computer-executable instructions on a computer-readable medium such as, for example, floppy disks, hard disks, optical disks, Flash ROMS, nonvolatile ROM, and RAM. Furthermore, it should be understood by one of skill in the art that the computer-executable instructions may be executed on a variety of processors such as, for example, microprocessors, digital signal processors, gate arrays, etc. For ease of exposition, not every step or element of the present invention is described herein as part of a computer system, but those skilled in the art will recognize that each step or element may have a corresponding computer system or software component. Such computer system and/or software components are therefore enabled by describing their corresponding steps or elements (that is, their functionality), and are within the scope of the present invention.

Having thus described at least illustrative embodiments of the invention, various modifications and improvements will readily occur to those skilled in the art and are intended to be within the scope of the invention. Accordingly, the foregoing description is by way of example only and is not intended as limiting. The invention is limited only as defined in the following claims and the equivalents thereto.

What is claimed is:

1. An apparatus comprising:

at least one channel receiving an electrical signal representing an acoustic signal generated by an instrument connected to the at least one channel, the instrument selected from a plurality of instruments;

at least one control allowing a user to select a setting of an equalization parameter, the at least one control defined by a set of control parameters, the set of control parameters based on the instrument; and a processor configured to equalize the electrical signal according to the selected setting.

2. The apparatus of claim 1 wherein the set of control parameters include a gain range, a center frequency, and a Q, the gain range defining a range of gains selectable by the at least one control.

3. The apparatus of claim 1 wherein the at least one control includes a first control, a second control, and a third control.

4. The apparatus of claim 3 wherein set of control parameters define a gain range for each of the first, second, and third controls, the first, second, and third controls operating as a three-band equalizer.

5. The apparatus of claim 4 wherein each band of the three-band equalizer is non-contiguous to each of the other bands.

6. The apparatus of claim 1 further comprising a memory readable by the processor, the memory storing the set of control parameters for the instrument.

7. A method of equalizing an electrical signal representing an acoustic signal generated by an instrument, the method comprising:

providing an equalizer/mixer configured to receive the electrical signal and equalize the electrical signal, the equalizer/mixer including a memory and a control adjustable by a user;

retrieving a first set of equalization parameters from the memory, the first set of parameters based on the instrument;

assigning a portion of the first set of parameters to the control; and equalizing the signal based on the first set of equalization parameters and a control setting of the control.

8. The method of claim 7 further comprising identifying the instrument.

9. The method of claim 8 wherein a user manually identifies the instrument to the equalizer/mixer.

10. The method of claim 8 wherein the equalizer/mixer automatically identifies the instrument using a handshake protocol between the instrument and the equalizer/mixer.

11. An apparatus comprising:

a plurality of channels, each of the plurality of channels adapted to receive an electrical signal representing an acoustic signal generated by an instrument connected to the channel;

at least one user-adjustable control for identifying the instrument connected to the one of the plurality of channels;

a non-volatile memory storing a plurality of equalization parameter sets, at least one of the plurality of equalization parameter sets based on the identified instrument; and a processor configured to retrieve the one of the plurality of equalization parameter sets based on the identified instrument and equalize the electrical signal based on the retrieved parameter set, wherein the retrieved parameter set defines a range of the at least one user-adjustable control, the processor equalizing the electrical signal representing the acoustic signal generated by the instrument based on a setting of the at least one user-adjustable control.

12. The apparatus of claim 11 further comprising a mixer configured to combine an equalized signal from at least one of the plurality of channels, the combined equalized signal played through an amplification system into a venue.

13. The apparatus of claim 11 wherein the at least one user-adjustable control selects a setting of an equalization parameter of the retrieved parameter set.

14. The apparatus of claim 11 wherein the at least one of the plurality of equalization parameter sets is based on a model of the identified instrument.

15. The apparatus of claim 11 wherein the at least one of the plurality of equalization parameter sets is based on a category of the identified instrument.

16. The apparatus of claim 11 wherein the electrical signal representing an acoustic signal generated by an instrument is from a live performance.

* * * * *